United States Patent [19]

Ellison

[11] Patent Number: 4,803,741

[45] Date of Patent: Feb. 14, 1989

[54] TOILET SEAT LIFTER

[76] Inventor: Taylor B. Ellison, P.O. Box 1508, Lake Placid, Fla. 33852

[21] Appl. No.: 107,107

[22] Filed: Oct. 13, 1987

[51] Int. Cl.[4] ..... A47R 13/10

[52] U.S. Cl. ..... 4/251; 4/308

[58] Field of Search ..... 4/257, 308, 338, 413; 74/512

[56] References Cited

U.S. PATENT DOCUMENTS

| | | | |
|---|---|---|---|
| 2,232,895 | 2/1941 | White | 4/257 |
| 2,705,330 | 4/1955 | Knydsen | 4/257 |
| 2,776,440 | 1/1957 | Miller | 4/257 |
| 3,345,650 | 10/1967 | Waters | 4/257 |
| 3,417,411 | 12/1968 | Greenwood | 4/257 |
| 3,516,095 | 6/1970 | Clifton et al. | 4/257 |
| 4,534,073 | 8/1985 | Smith | 4/251 |

*Primary Examiner*—Henry K. Artis
*Assistant Examiner*—Ernest G. Cusick
*Attorney, Agent, or Firm*—Alfred E. Wilson

[57] ABSTRACT

In an effort to avoid touching a toilet seat in a public restroom many men use their foot to raise the toilet seat. Many men do not even bother to lift the seat. This invariably results in the seat becoming wet, which is quite offensive for parties who must use the seat later. In the home it is desirable to have a toilet seat lifter available for use when company comes, and to maintain a high degree of cleanliness when the bathroom is used by both sexes. This is particularly true when there are children in the family. I have devised a readily operable toilet seat lifting device that can be elevated merely by stepping on a lever connected to the seat, and holding the lever in the depressed position during the time they are utilizing the facility. When the foot is released from the lever the seat returns to the horizontal position. When the device is in use both feet can be comfortably placed on the floor, and it is not necessary to have one foot elevated above the other. When the participant releases the foot pedal the seat lowers to the horizontal position, an air cylinder being provided to cushion the downward movement of the seat. If desired a linkage can be provided to close the toilet cover when the seat is lowered.

1 Claim, 3 Drawing Sheets

TOILET SEAT LIFTER

BACKGROUND OF THE INVENTION

With the rapid spreading of various diseases such as "Aids" many men have become extremely cautious when using public toilets, and in many instances they will not use their hands to lift the toilet seat. This results in the toilet seat becoming wet, thus providing an even more repulsive condition for others that must use the facility later.

DESCRIPTION OF THE PRIOR ART

Insofar as is known no one has succeeded in providing a readily operable linkage for elevating the toilet seat for non-sitting purposes. Many men will use their foot to elevate the toilet seat, and when they do, they generally leave it standing in the vertical position because they do not want to touch it with their hand, and it is a little difficult to use the foot to lower the seat. In many instances they merely pull it forward with their foot and let it crash down.

SUMMARY OF THE INVENTION

I have succeeded in providing a lever actuated toilet seat raiser wherein a foot operated lever extends along the side of the toilet bowl, and is operably connected with the seat to elevate the seat when the lever is depressed. The linkage is such that the user can have both feet on the floor, and the seat will be held in the elevated position as long as the lever is held in the depressed position. When the lever is released the seat hinges forwardly to the horizontal position.

DESCRIPTION OF THE PREFERRED EMBODIMENT

Figure 1:
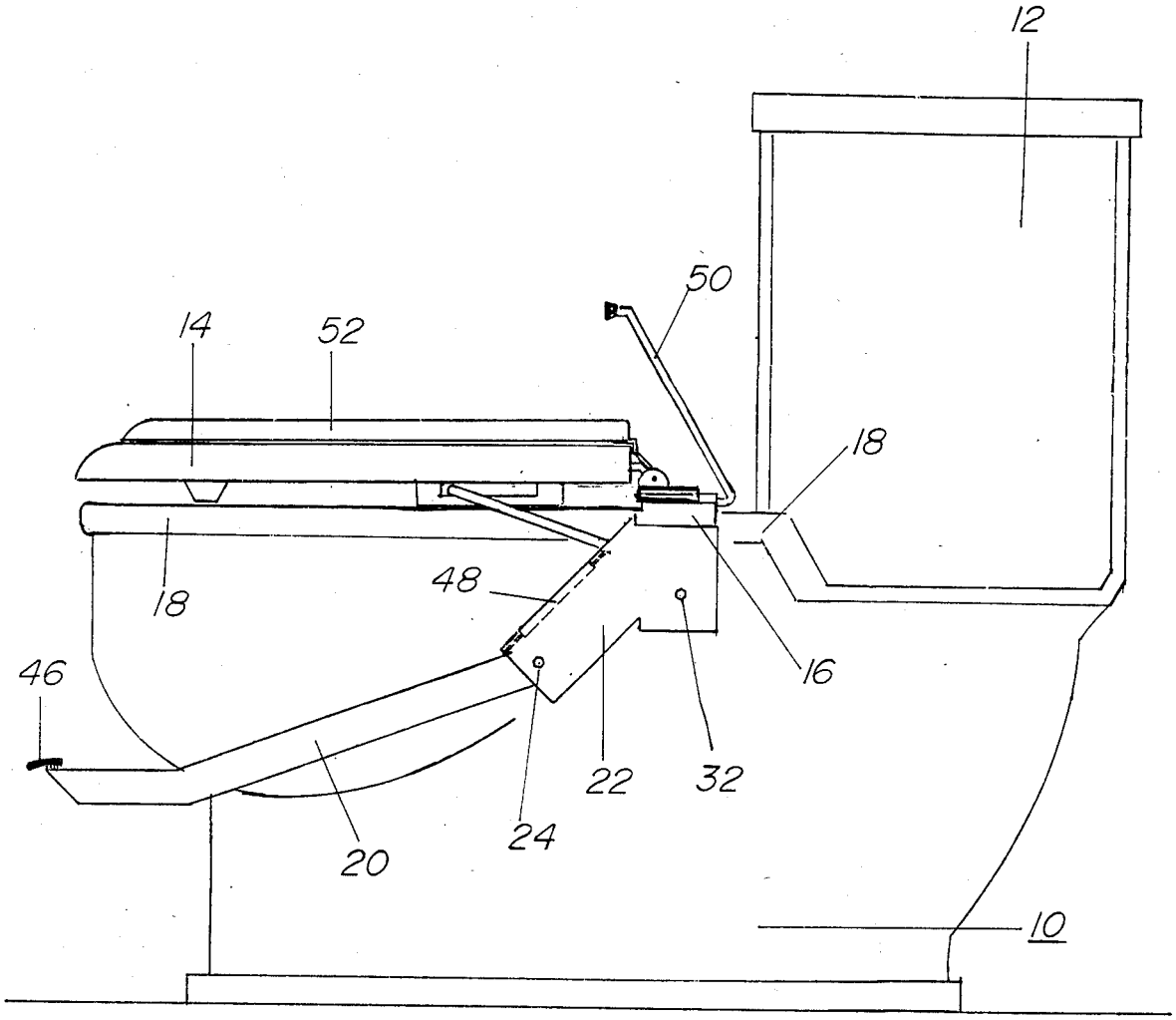
FIG. 1 is a side elevational view of a foot operated linkage to elevate the toilet seat, shown in the inoperative position with the seat positioned horizontally.

Referring now to FIG. 1, a toilet bowl 10 equipped with a water storage tank 12 is provided with a seat 14 hingedly mounted on a bracket 16 secured to the top 18 of the toilet bowl 10. The bracket 16 has spaced holes to align with the standardized holes by which toilet seats are secured to toilet bowls.

Figure 2:
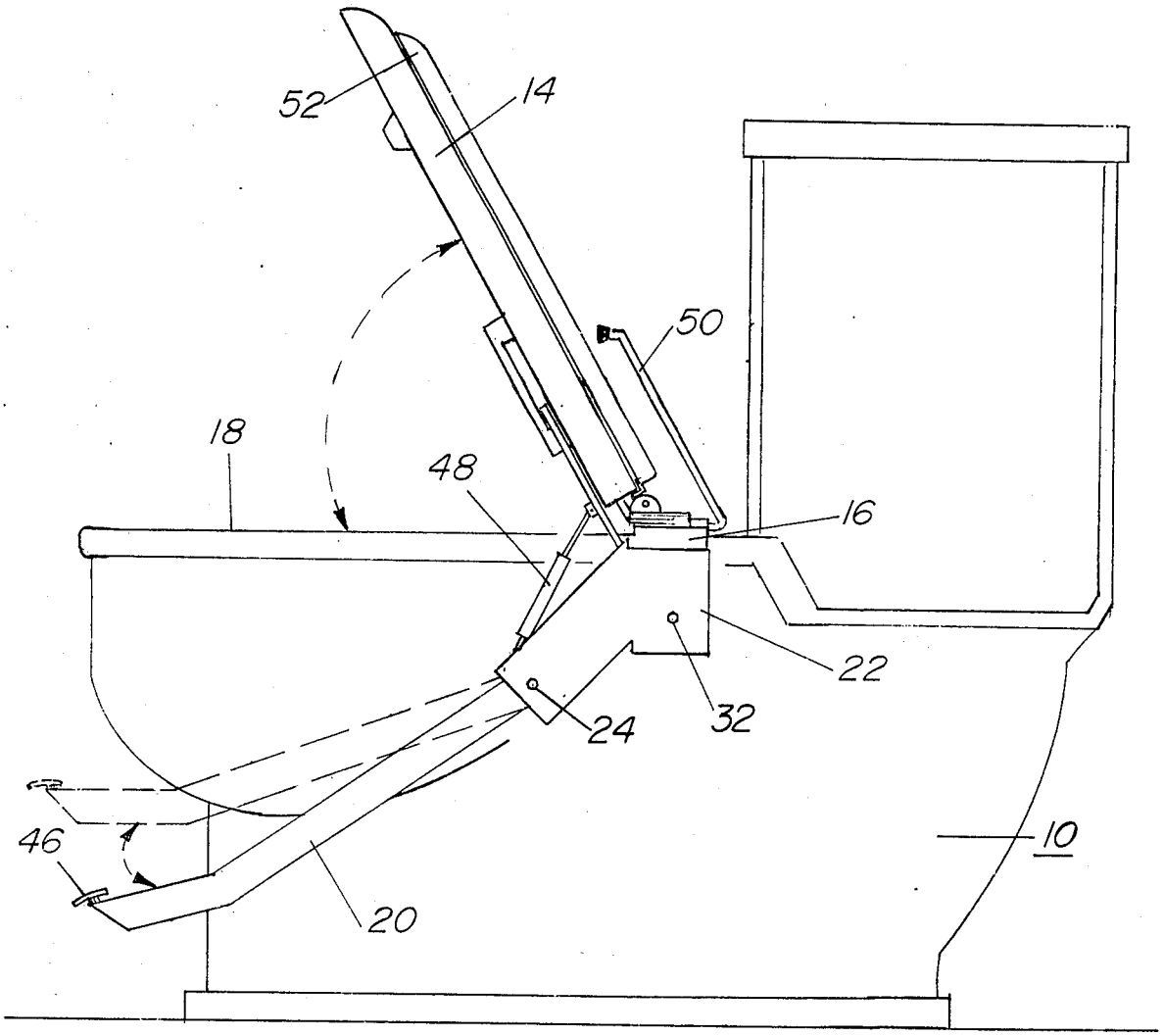
FIG. 2 is a view similar to FIG. 1 showing the foot operated linkage in the actuated position with the toilet seat in the elevated position, and the foot operated linkage fully actuated.
Figure 3:
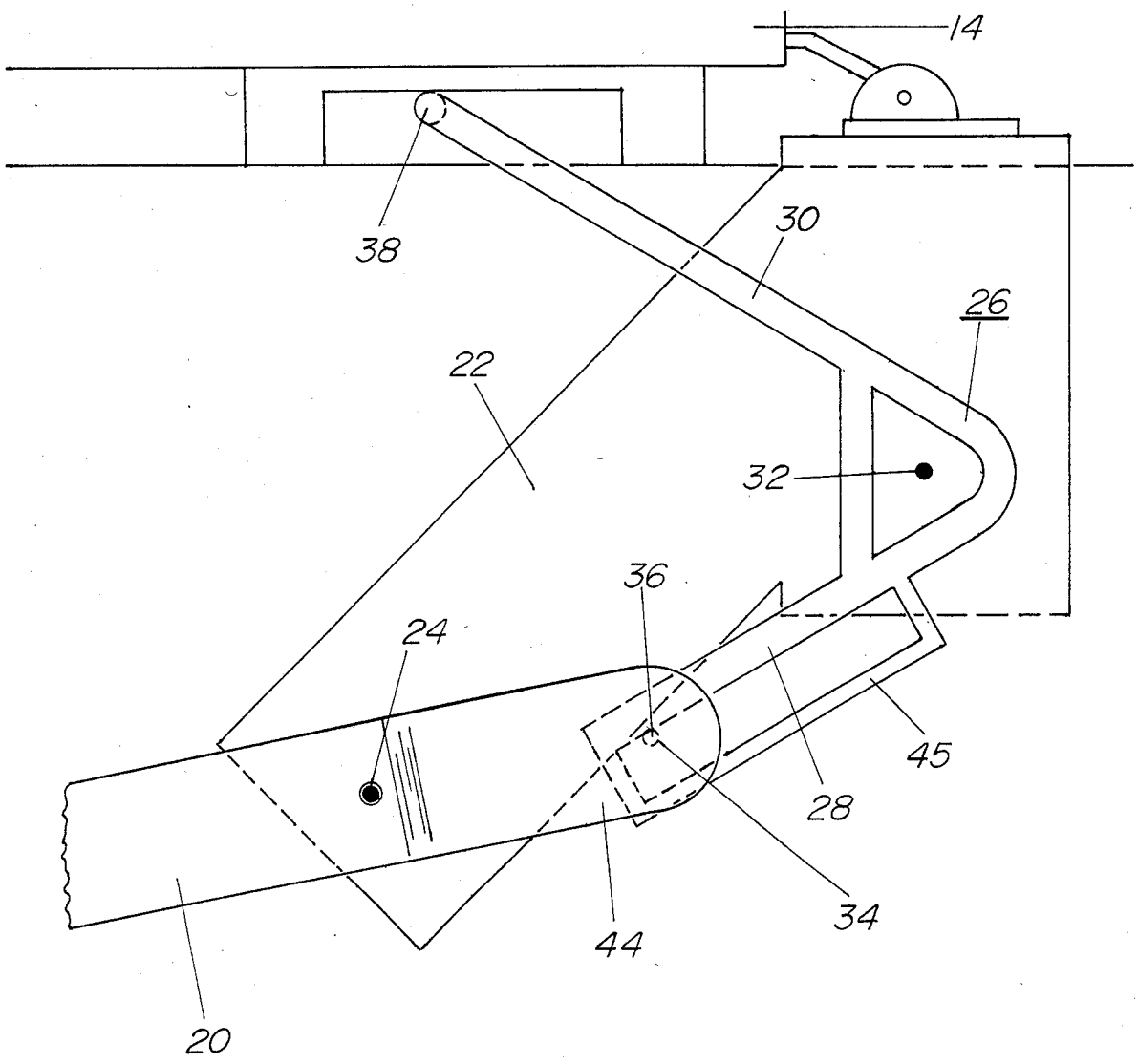
FIG. 3 is a side elevational view of the seat actuating linkage.

A foot actuated lever 20 is operably connected to the hingedly mounted seat 14. When the lever 20 is in the elevated or inoperative position as shown in FIG. 1, the seat 14 is in the down or horizontal position. When the lever 20 is depressed to the floor as shown in FIG. 2 the seat 14 is hingedly moved to the elevated position as shown in FIG. 2.

The foot actuated lever 20 which actuates the seat 14 is pivotally mounted on a down-turned flange 22 carried by the bracket 16 by which the seat 14 is secured to the top 18 of the toilet bowl 10. The pivotal mounting of the foot lever 20 is at the fulcrum point 24 on the downwardly extending flange 22.

A motion transmitting linkage 26 having angularly related arms 28 and 30 is pivotally mounted at 32 on the flange 22.

The foot lever 20 has a roller 34 mounted on a stud 36 at its inner end 44 to engage and actuate the underside of the arm 28. A bracket 45 carried by the arm 28 is provided to hold the end of the lever 20 in contact with the underside of the arm 28. The arm 30 fixed to the arm 28 pivoted on the bracket 22 at 32 extends outwardly and has a roller 38 mounted on a stud extending at right angles to the arm 30 and extending under the seat 14 to elevate the seat when the lever 20 is actuated.

The linkage between the foot operated lever 20 and the toilet seat 14 can be varied to change the force required to be exerted on the foot pad 46 of the foot lever 20 to elevate the toilet seat 14. For example the distance between the foot pad 46 at the actuated end of the lever 20 to the pivotal mounting of the lever 20 on the bracket 22 in one of the models we constructed is 13". The distance to the end 44 of the lever 20 which contacts the arm 28 of the linkage 26 pivoted on the bracket 22 is approximately 3". The arm 30 of the linkage 26 from the pivotal connection on the bracket 22 to the point of contact of the roller 34 with the underside of the toilet seat 14 is approximately 6". This linkage requires a predetermined force to be exerted on the foot pad 46 of the lever 20 to move the toilet seat 14. This force can be increased or decreased as desired by changing the linkage.

It will be understood that any desired motion transmitting linkage can be substituted for that illustrated to elevate the toilet seat 14 when the foot pad 46 of the lever 20 is actuated.

Attention is directed to the fact that for ease of operation the toilet seat 14 is movable from the horizontal position to an elevated position of approximately 80° to the horizontal. With that elevation the seat 14 will pivot to horizontal position, and it is not necessary to provide any starter mechanism to start the movement of the seat. It has been found from extensive testing that a position of approximately 80° is adequate for all normal usages. An air entrapped or spring operated assembly 48 may be provided to prevent the pivoted seat 14 from crashing down when returning to the horizontal position.

If desired an actuator 50 operably connected to the seat operating linkage can be provided to initiate the closing movement of the toilet lid 52 if desired.

I claim:

1. A toilet seat assembly with a lifting arrangement to move a toilet seat from the horizontal position to an almost vertical position, comprising, in combination:

(a) a bowl (10) with a top (18) having a rear part;

(b) a toilet seat (14), with a front and rear section, a seat bracket (16) for securing said toilet seat rear section to the top rear part of said bowl, a down-turned flange (22) carried by said bracket (16);

(c) a motion transmitting linkage (26) including angularly related outwardly extending lower and upper arms (28, 30), with a pivot (32) between the arms mounted on said flange (22), an underside to said lower arm and an outer end on said upper arm;

(d) a foot actuated lever (20) with a fulcrum point (24), an inner end (44) and an outer end, said fulcrum point (24) being coupled to said flange (22) with a foot pedal (46) at the outer end;

(e) a roller (34) mounted on a stud (36) at the inner end (44) engaging and actuating the underside of the lower arm (28) with an arm bracket (45) carried by said arm (28) to hold said lever (20) in contact with the underside of the lower arm (28); and, (f) a roller (38) mounted on the outer end of the upper arm (30) and extending at right angles to the arm and extending under the seat (14) to elevate the seat when the lever (20) is actuated, also, air-cylinder means between the flange (22) and the seat to cushion the downward movement of the seat.

* * * * *